US011404822B2

(12) United States Patent
Motoshige

(10) Patent No.: US 11,404,822 B2
(45) Date of Patent: Aug. 2, 2022

(54) FITTING CONNECTOR

(71) Applicant: Yazaki Corporation, Tokyo (JP)

(72) Inventor: Yuichi Motoshige, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 7 days.

(21) Appl. No.: 17/226,478

(22) Filed: Apr. 9, 2021

(65) Prior Publication Data

US 2021/0336388 A1 Oct. 28, 2021

(30) Foreign Application Priority Data

Apr. 24, 2020 (JP) ..... JP2020-077008

(51) Int. Cl.
*H01R 13/62* (2006.01)
*H01R 13/629* (2006.01)

(52) U.S. Cl.
CPC ... *H01R 13/62933* (2013.01); *H01R 2201/26* (2013.01)

(58) Field of Classification Search
CPC .. H01R 12/00; H01R 12/52; H01R 13/62933; H01R 13/62938; H01R 13/62955; H01R 13/62988; H01R 2201/26
See application file for complete search history.

(56) References Cited

U.S. PATENT DOCUMENTS 5,556,286 A * 9/1996 Ikesugi ..... H01R 12/716 439/31
5,769,650 A * 6/1998 Aoyama ..... H01R 13/4365 439/189
6,652,322 B2 * 11/2003 Ito ..... H01R 12/721 439/857
10,008,805 B2 * 6/2018 Tabata ..... H01R 13/62938
10,044,115 B2 * 8/2018 Tran ..... H01R 12/85
10,236,631 B2 * 3/2019 An ..... H01R 13/6315
10,243,302 B2 * 3/2019 Ju ..... H01R 13/646
10,476,191 B2 * 11/2019 Venaleck ..... H01R 12/585
10,673,158 B2 * 6/2020 Aoki ..... H01R 12/73
10,998,666 B2 * 5/2021 Shioda ..... H01R 43/24
11,239,591 B2 * 2/2022 Morita ..... H01R 13/2492
11,349,240 * 5/2022 Yoshida ..... H01R 13/6581
2006/0211286 A1 9/2006 Shuey

FOREIGN PATENT DOCUMENTS

JP 2008-533684 A 8/2008
JP 2010-146950 A 7/2010

* cited by examiner

*Primary Examiner* — Thanh Tam T Le
(74) *Attorney, Agent, or Firm* — Sughrue Mion, PLLC

(57) ABSTRACT

In a fitting connector, a first housing includes a reference protrusion body and a high-pressure protrusion body, the reference protrusion body elastically deforming reference elastic connection bodies in an opening direction while sliding free end sides of the reference elastic connection bodies of a plurality of elastic connection bodies of a second terminal fitting as a first fitting portion and a second fitting portion of a second housing oriented in a temporarily fitting state are fitted and inserted, and allowing electric contact portions of the reference elastic connection bodies to ride over in a case of being temporarily fitted, and the high-pressure protrusion body more greatly elastically deforming a high-pressure elastic connection body in the opening direction than the reference elastic connection bodies while sliding a free end side of the high-pressure elastic connection body of the elastic connection bodies.

6 Claims, 12 Drawing Sheets

FITTING CONNECTOR

CROSS-REFERENCE TO RELATED APPLICATION(S)

The present application claims priority to and incorporates by reference the entire contents of Japanese Patent Application No. 2020-077008 filed in Japan on Apr. 24, 2020.

BACKGROUND OF THE INVENTION

1. Field of the Invention

The present invention relates to a fitting connector.

2. Description of the Related Art

In the related art, fitting connectors, such as a female connector and a male connector, that are fitted and connected to each other are used for electric connection between two parts. Known as this type of fitting connectors involve a configuration in which each connector is arranged to be in a temporarily fitting state and fitted and connected to each other to be in a completely fitting state while applying a fitting insertion force corresponding to a rotary operation force of a lever member, an axial force of a screw member, or the like to the fitting portions of the connectors. This fitting connector saves a fitting operation force of an operator who performs the fitting and connection by applying the fitting insertion force to the fitting portions until the temporarily fitting state shifts to the completely fitting state. Examples of a fitting connector with this type of operation force auxiliary mechanism are disclosed in Japanese Patent Application Laid-open No. 2010-146950 and Japanese Laid-open Patent Publication (Translation of PCT Application) No. 2008-533684.

The fitting connector with an operation force auxiliary mechanism can reduce the fitting operation force of the operator, but there is a risk of causing the following inconveniences in a case in which the fitting portions of the connectors are not arranged in a specified temporarily fitting state. For example, in the fitting connector of that case, even though the fitting insertion force is generated between the fitting portions by the lever member or the like, the fitting portions cannot be fitted and inserted to become the completely fitting state, and there is a possibility that terminal fittings are not stably electrically connected to each other. In the fitting connector of that case, there is a possibility that an overload may be generated between the fitting portions or between the terminal fittings due to the fitting insertion force generated between the fitting portions. However, in this fitting connector, it is difficult to visually determine whether the fitting portions are arranged in the temporarily fitting state as specified.

SUMMARY OF THE INVENTION

Therefore, an object of the present invention is to provide a fitting connector that allows easy identification of the temporarily fitting state.

In order to achieve the above mentioned object, a fitting connector according to one aspect of the present invention includes a first connector including a first housing that has a first fitting portion, and a first terminal fitting that is housed in the first housing; a second connector including a second housing that has a second fitting portion capable of being fitted and inserted to the first fitting portion along a connector insertion direction, and a second terminal fitting that is housed in the second housing and electrically connected to the first terminal fitting in a case where the first fitting portion and the second fitting portion are in a completely fitting state; and an operation force auxiliary mechanism that generates a fitting insertion force corresponding to an operation force for an operation auxiliary member between the first fitting portion and the second fitting portion, and moves the first fitting portion and the second fitting portion relative to each other along the connector insertion direction to be set from a temporarily fitting state to the completely fitting state, wherein the second terminal fitting includes a base body and a plurality of elastic connection bodies, the elastic connection bodies being disposed in an intersecting state to the base body, arranged in an orthogonal direction to the connector insertion direction with electric contact portions on a free end side, which are oriented in the same direction, cantilever shaped, and capable of elastically deforming the electric contact portions toward an opening direction in which the electric contact portions are pulled away from the first terminal fitting, and the first housing includes a reference protrusion body and a high-pressure protrusion body, the reference protrusion body elastically deforming a reference elastic connection body in the opening direction while sliding the free end side of the reference elastic connection body of the elastic connection bodies as the first fitting portion and the second fitting portion oriented in the temporarily fitting state are fitted and inserted, and allowing each electric contact portion of the reference elastic connection body to ride over in a case in which the first fitting portion and the second fitting portion are temporarily fitted, and the high-pressure protrusion body more greatly elastically deforming a high-pressure elastic connection body in the opening direction than the reference elastic connection body while sliding the free end side of the high-pressure elastic connection body of the elastic connection bodies as the first fitting portion and the second fitting portion oriented in the temporarily fitting state are fitted and inserted, allowing each electric contact portion of the high-pressure elastic connection body to ride over in the case in which the first fitting portion and the second fitting portion are in the temporarily fitting state, and returning the high-pressure elastic connection body toward a direction opposite to the opening direction to the same position as the reference elastic connection body.

According to another aspect of the present invention, in the fitting connector, it is preferable that the reference protrusion body and the high-pressure protrusion body protrude from a protrusion reference surface of the first housing, the high-pressure protrusion body includes a high-pressure sliding surface over which the free end side of the high-pressure elastic connection body slides, and a connection end surface through which the high-pressure sliding surface is connected to the protrusion reference surface at the connector insertion direction side, and the high-pressure sliding surface includes a high-pressure portion most elastically deforming the high-pressure elastic connection body in the opening direction at a boundary with the connection end surface.

According to still another aspect of the present invention, in the fitting connector, it is preferable that the high-pressure sliding surface is one or more inclined surfaces each greatly protruding from the protrusion reference surface as closer to the connector insertion direction side, or an arcuate surface gradually greatly protruding from the protrusion reference surface toward the connector insertion direction.

According to still another aspect of the present invention, in the fitting connector, it is preferable that the second terminal fitting includes two combinations of the elastic connection bodies, and the electric contact portions of the elastic connection bodies in each of the two combinations are disposed to face each other with a gap.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
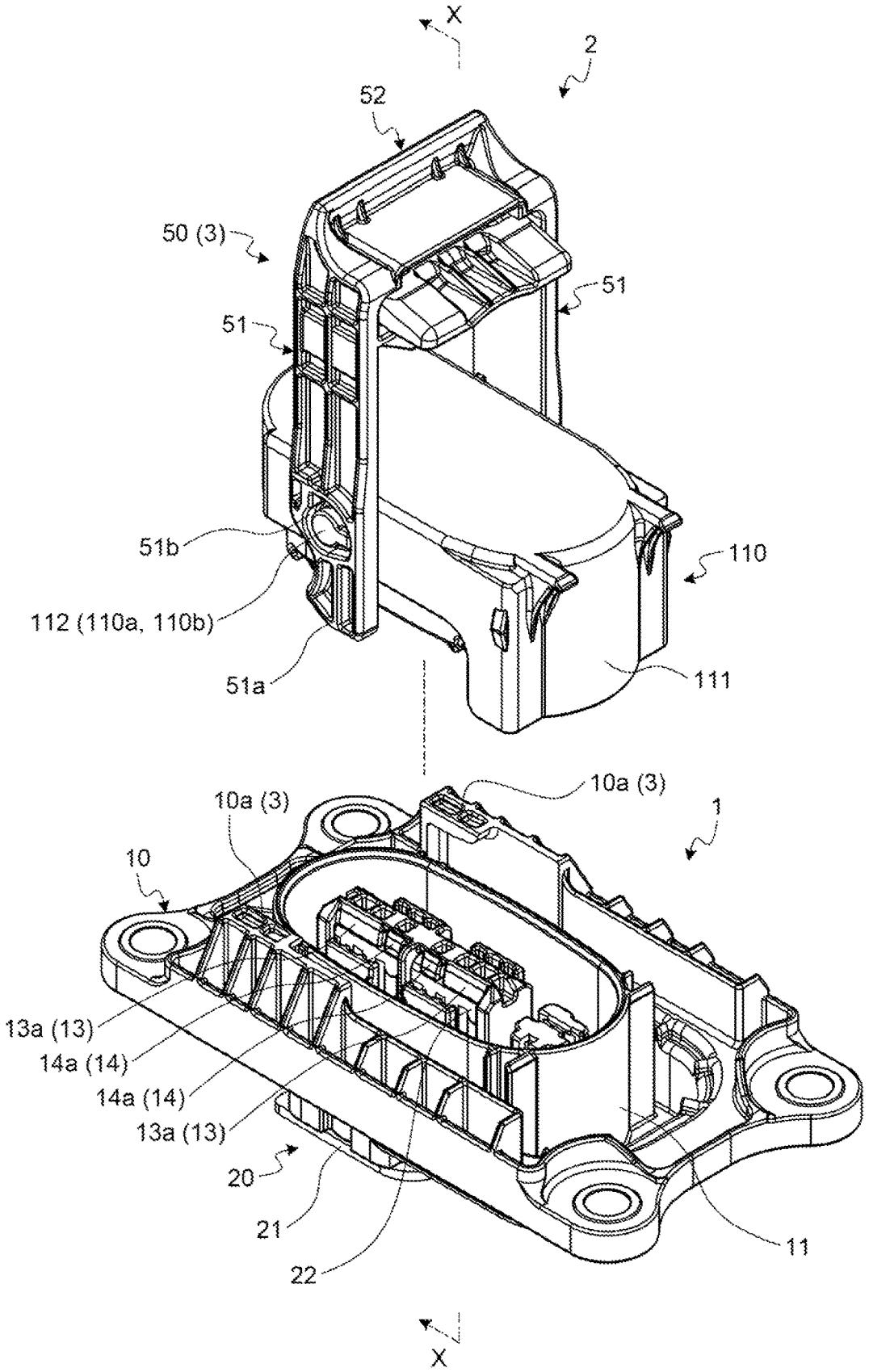
FIG. 1 is a perspective view illustrating a fitting connector according to an embodiment in which a first connector and a second connector are in a state of being separated from each other.

Hereinafter, an embodiment of a fitting connector according to the present invention will be described in detail with reference to the drawings. The present invention is not limited to this embodiment.

Embodiment

The fitting connector according to the present embodiment includes two connectors that are fitted and connected to each other, and the two connectors are fitted and connected to be electrically connected to each other. The fitting connector according to the present embodiment may electrically connect a device of one connector side to a device of the other connector side, and the other connector may be pulled out from or inserted into one connector to allow connection and disconnection of an electric circuit.

One embodiment of the fitting connector according to the present invention will be described in detail with reference to FIG. 1 to FIG. 12.

The fitting connector of the present embodiment includes a first connector 1 and a second connector 2 that are fitted and connected to each other (FIG. 1 to FIG. 7). In the fitting connector illustrated herein, the first connector 1 is freely inserted to and pulled out from the second connector 2, and the second connector 2 allows the connection and disconnection of the electric circuit of the first connector 1.

Here, the first connector 1 is provided over an electric circuit of a device (not illustrated). The device is, for example, a drive device for vehicles (such as electric motors or inverters of electric vehicles or hybrid vehicles). The electric circuit of the device is connected by this first connector 1 in a case in which the first connector 1 and the second connector 2 are in a completely fitting state, and the electric circuit of the device is disconnected in a case in which the first connector 1 and the second connector 2 are not in the completely fitting state.

The first connector 1 includes a first housing 10 and a first terminal fitting 20 (FIG. 1 to FIG. 7). On the other hand, the second connector 2 includes a second housing 110 and a second terminal fitting 120 (FIG. 2, FIG. 3, FIG. 5, and FIG. 7).

The first housing 10 and the second housing 110 are formed of an insulating material such as a synthetic resin. The first housing 10 includes a first fitting portion 11 (FIG. 1, FIG. 3 to FIG. 5, and FIG. 7). The second housing 110 includes a second fitting portion 111 (FIG. 1 to FIG. 7). Each of the first fitting portion 11 and the second fitting portion 111 is formed to have a shape capable of being fitted and inserted along a connector insertion direction and capable of being pulled out along a connector pulling out direction. For example, each of the first fitting portion 11 and the second fitting portion 111 is formed in a cylindrical shape, and a cylindrical axial direction thereof is the connector insertion and pulling out direction (the connector insertion direction and the connector pulling out direction), so that the first fitting portion 11 and the second fitting portion 111 are inserted into and pulled out from each other. The first fitting portion 11 illustrated herein is formed in a cylindrical shape in which one end in the cylindrical axial direction is closed by a closing wall. On the other hand, the second fitting portion 111 illustrated herein is formed in a cylindrical shape in which both ends in the cylindrical axial direction are opened. Each of the first fitting portion 11 and the second fitting portion 111 illustrated herein has an orthogonal cross-section to the cylindrical axial direction, which is formed as an elliptical annular cylinder.

Each of the first terminal fitting 20 and the second terminal fitting 120 is formed of a conductive material such as metal. For example, these first terminal fitting 20 and second terminal fitting 120 are formed into predetermined shapes by press forming such as bending processing or cutting processing on a metal plate serving as a base material.

Figure 2:
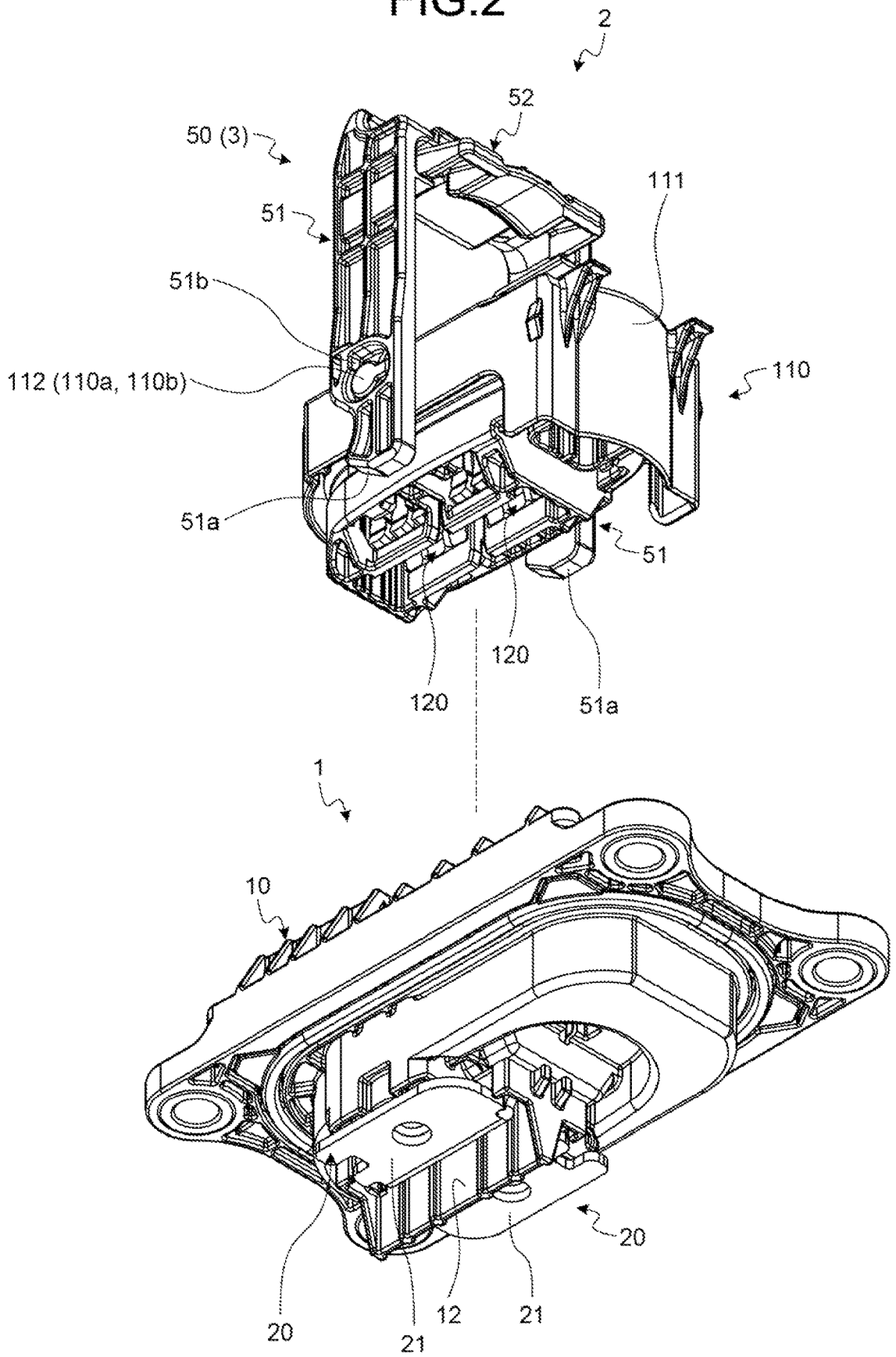
FIG. 2 is a perspective view of the fitting connector according to the embodiment in which the first connector and the second connector are in the state of being separated from each other as viewed from a different angle.
Figure 3:
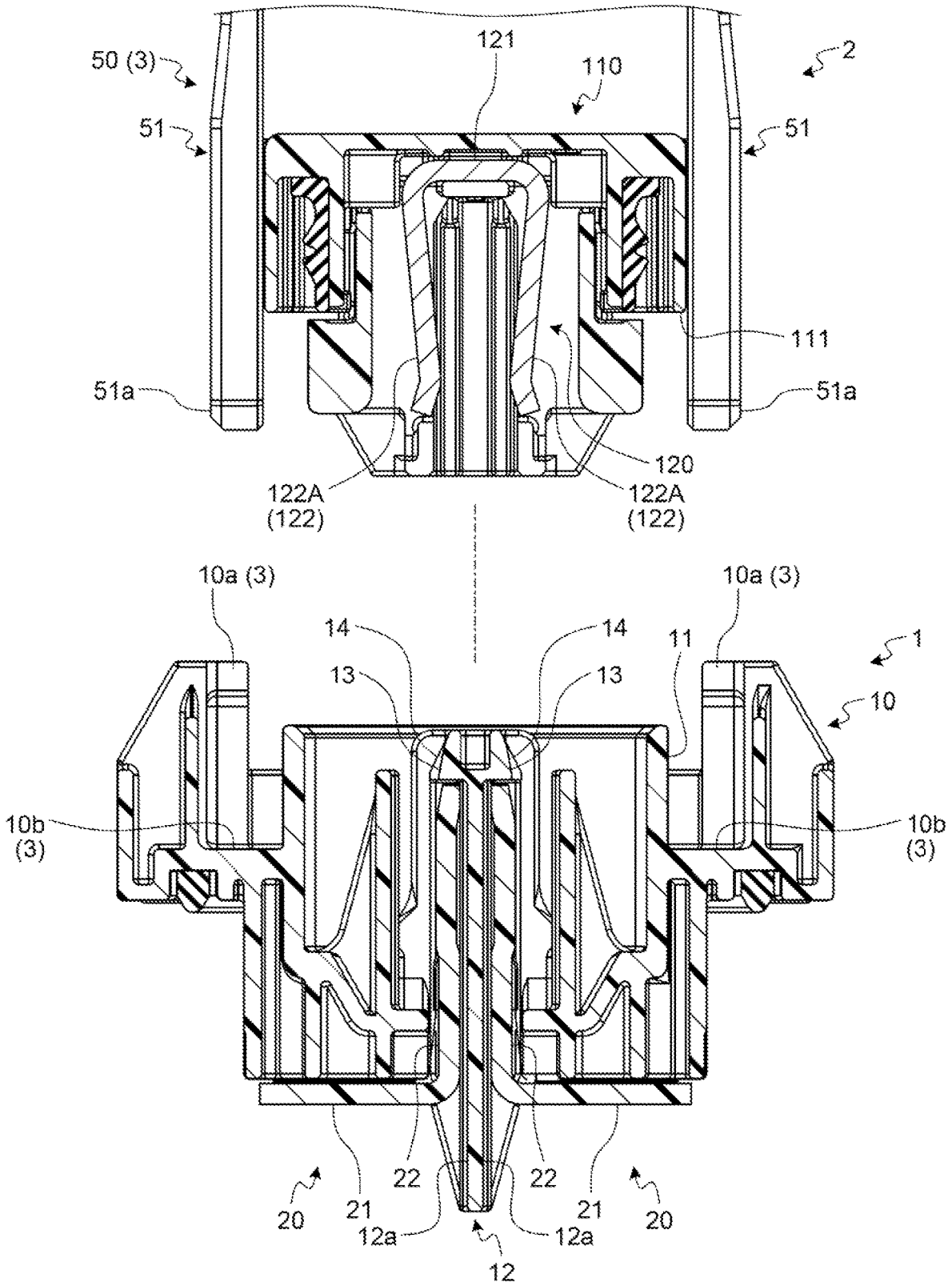
FIG. 3 is a partially enlarged view of a cross-section taken along line X-X of FIG. 1.

The first terminal fitting 20 is housed inside the first fitting portion 11 of the first housing 10 (FIG. 1 and FIG. 3). Two first terminal fittings 20 are housed in the first fitting portion 11 illustrated herein. The second terminal fitting 120 is housed inside the second fitting portion 111 of the second housing 110 (FIG. 2 and FIG. 3). Two second terminal fittings 120 are housed in the second fitting portion 111 illustrated herein. In this fitting connector, each of the first terminal fittings 20 is electrically connected by the two second terminal fittings 120.

The first terminal fitting 20 includes a fixed body 21 having a flat plate-shape and an electric connection body 22 having a male tab-shape formed of a rectangular flat plate, which is orthogonally disposed to the fixed body 21 (FIG. 1, FIG. 3, FIG. 5, and FIG. 7 to FIG. 9). The fixed body 21 is a part for fixing the first terminal fitting 20 to the first housing 10. In the first terminal fitting 20, the fixed body 21 is fixed to the first housing 10 by screwing or the like. The electric connection body 22 is a part physically and electrically connected to the second terminal fitting 120.

In the first fitting portion 11, planar surfaces of the electric connection bodies 22 of the first terminal fittings 20 are disposed to face each other on one side with a gap (FIG. 1, FIG. 3, FIG. 5, FIG. 7, and FIG. 8). The first housing 10 includes a flat plate-shaped partition wall 12 interposed in the gap between two electric connection bodies 22 (FIG. 2, FIG. 3, FIG. 5, FIG. 7, and FIG. 9).

Figure 8:
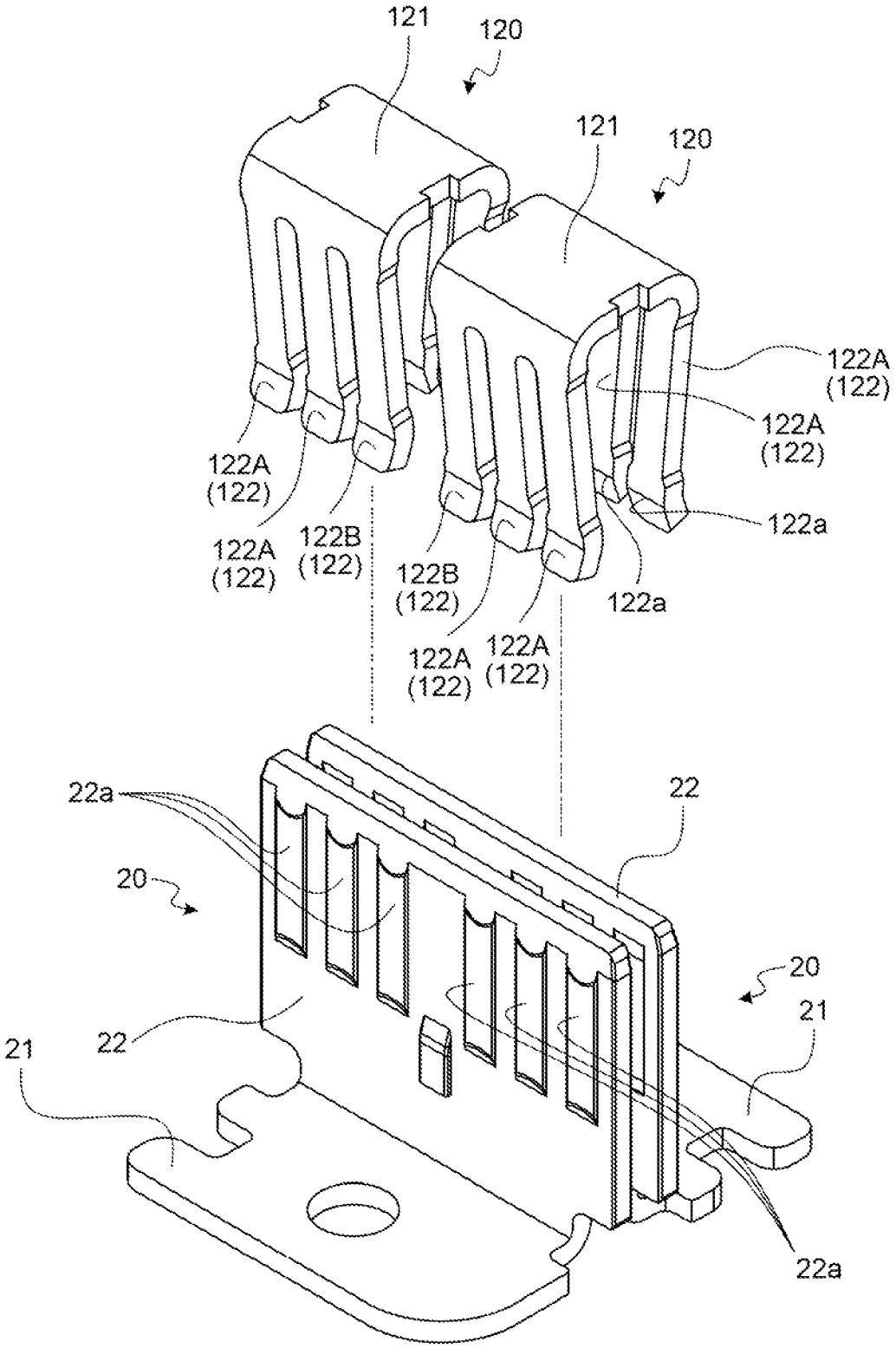
FIG. 8 is an exploded perspective view in which a first terminal fitting and a second terminal fitting are extracted and illustrated.

In each of the electric connection bodies 22, electric contact portions 22*a* are provided on the planar surface on the other side in a bulging state (FIG. 8). Each of the electric contact portions 22*a* is provided for each of electric contact portions 122*a* of the second terminal fitting 120 described later.

The second terminal fitting 120 includes a base body 121 and a plurality of elastic connection bodies 122. The elastic connection bodies 122 are disposed in an intersecting state to the base body 121, arranged in an orthogonal direction to the connector insertion direction with electric contact portions 122*a* on a free end side, which are oriented in the same direction, and cantilever shaped (FIG. 3, FIG. 5, and FIG. 7 to FIG. 9). The elastic connection bodies 122 are formed such that the electric contact portions 122*a* can be deformed toward an opening direction in which the electric contact portions 122*a* are pulled away from the electric contact portions 22*a* of the first terminal fitting 20, and the electric contact portions 122*a* can be elastically deformed toward a direction opposite to the opening direction in which the electric contact portion 122*a* is brought closer to the electric contact portion 22*a* of the first terminal fitting 20. In the second terminal fitting 120 illustrated herein, all the elastic connection bodies 122 are formed such that each of the elastic connection bodies 122 generates a spring force of the same magnitude in a case in which the amount of elastic deformation is the same.

Figure 9:
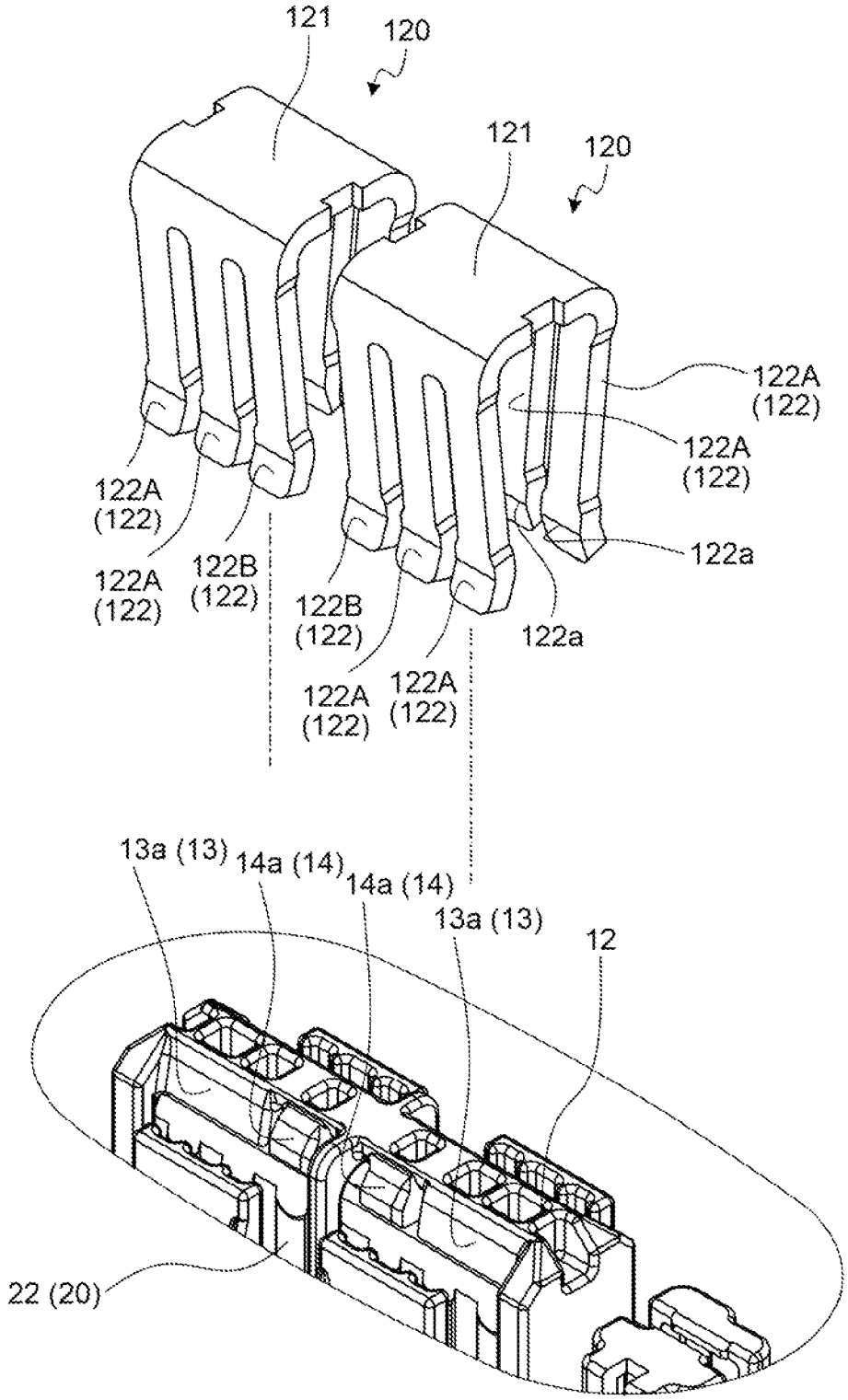
FIG. 9 is an exploded perspective view in which the first terminal fitting and the second terminal fitting in a first housing are extracted and illustrated.

The second terminal fitting 120 illustrated herein is formed to have two combinations of the elastic connection bodies 122 that are arranged in one row (FIG. 8 and FIG. 9). In the second terminal fitting 120, the combination of the elastic connection bodies 122 protrudes from each of two edges extending to the same direction in the base body 121 having a rectangular flat plate-shape, and the electric contact portions 122*a* of the respective elastic connection bodies 122 in each of the two combinations are disposed to face each other with a gap. That is, the second terminal fitting 120 is formed as a so-called clip-shaped terminal fitting. Therefore, the electric connection bodies 22 of the two first terminal fittings 20 are fitted between the combination on one side of the elastic connection bodies 122 and the combination on the other side of the elastic connection bodies 122 of the second terminal fitting 120. As a result, all the elastic connection bodies 122 of the second terminal fitting 120 are elastically deformed in the opening direction, and the electric connection bodies 22 are sandwiched due to the reaction force accompanying the elastic deformation, which acts from each of the other planar surface sides, so that the elastic connection bodies 122 are fitted and connected to the electric connection bodies 22. Therefore, the combination on one side of the elastic connection bodies 122 of the second terminal fitting 120 is electrically connected to the electric connection bodies 22 on one side, and the combination on the other side of the elastic connection bodies 122 is electrically connected to the electric connection bodies 22 on the other side, so that the two first terminal fittings 20 are electrically connected by the second terminal fitting 120.

The second terminal fitting 120 may include only one combination of the elastic connection bodies 122 that are arranged in one row in a case in which the fitting connector electrically connects a device on the first connector 1 side and a device on the second connector 2 side to each other. In this case of the second terminal fitting 120 (not illustrated), the combination of the elastic connection bodies 122 protrudes from one side of the two edges extending to the same direction in the base body 121 having a rectangular flat plate-shape, and a flat plate-shaped wall body protrudes from the other side of the two edges, so that a planar surface of the wall body and each of the electric contact portions 122*a* in the combination of the elastic connection bodies 122 are disposed to face each other with a gap. That is, in this case, the second terminal fitting 120 is also formed as a so-called clip-shaped terminal fitting.

In this fitting connector, the first fitting portion 11 and the second fitting portion 111 are fitted and inserted to a specified fitting position in the connector insertion direction, so that the first fitting portion 11 and the second fitting portion 111 are in the completely fitting state, and at this time, the first terminal fitting 20 and the second terminal fitting 120 are electrically connected to each other. In addition, in this fitting connector, in a case in which the first fitting portion 11 and the second fitting portion 111 are in a separated state or a half-fitting state, which is not fitted and inserted to the specified fitting position, the first terminal fitting 20 and the second terminal fitting 120 are not electrically connected. In the fitting connector illustrated herein, in the case in which the first fitting portion 11 and the second fitting portion 111 are the completely fitting state, each of the first terminal fittings 20 is electrically connected by the second terminal fittings 120, so that the disconnected electric circuit of the device is connected. In addition, in the fitting connector illustrated herein, in a case in which the first fitting portion 11 and the second fitting portion 111 are not in the completely fitting state (in the separated state or half-fitting state), each of the first terminal fittings 20 is not electrically connected by the second terminal fittings 120, so that the electric circuit of the device is disconnected.

Figure 4:
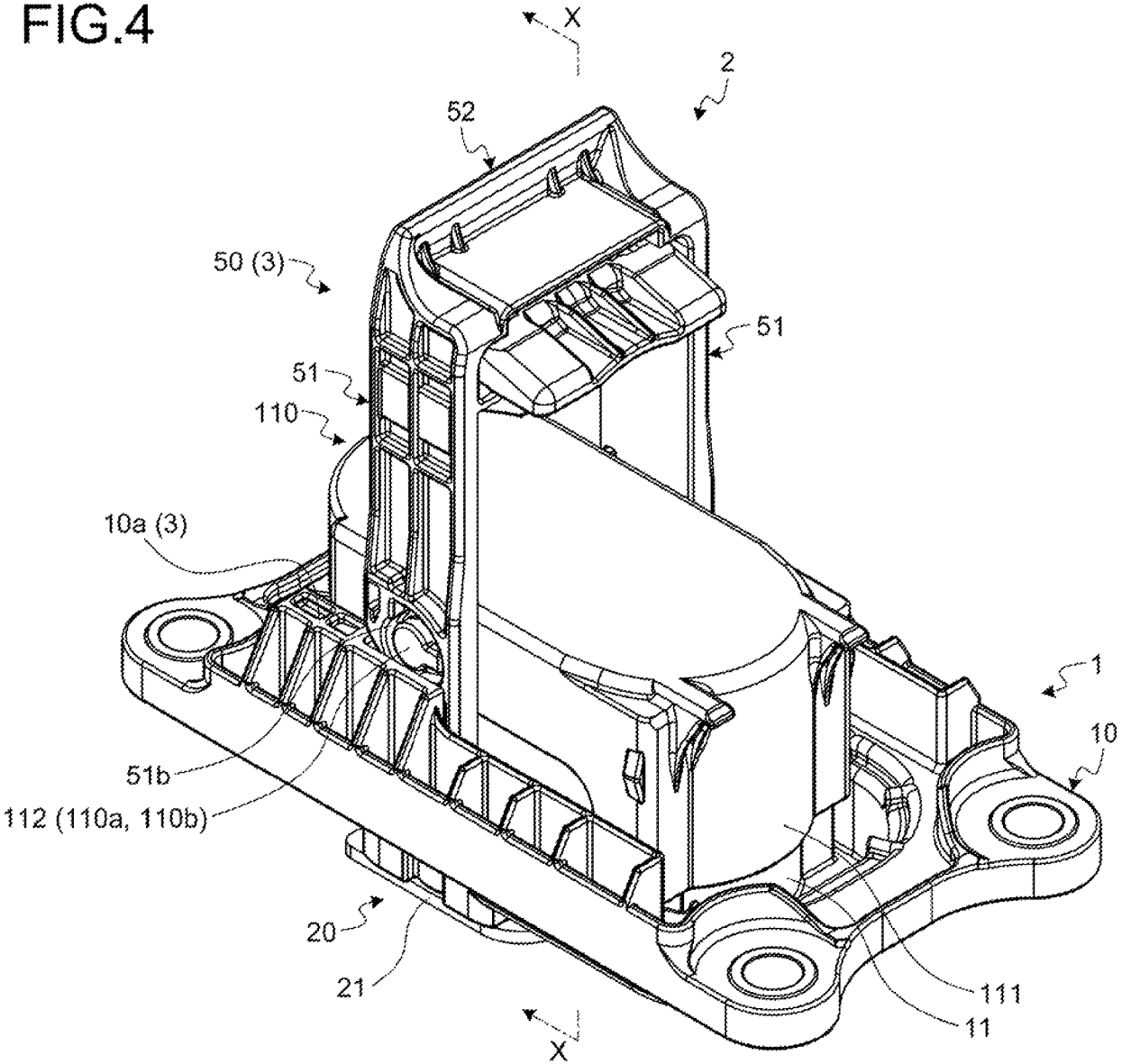
FIG. 4 is a perspective view illustrating the fitting connector according to the embodiment in which the first connector and the second connector are in a temporarily fitting state.
Figure 5:
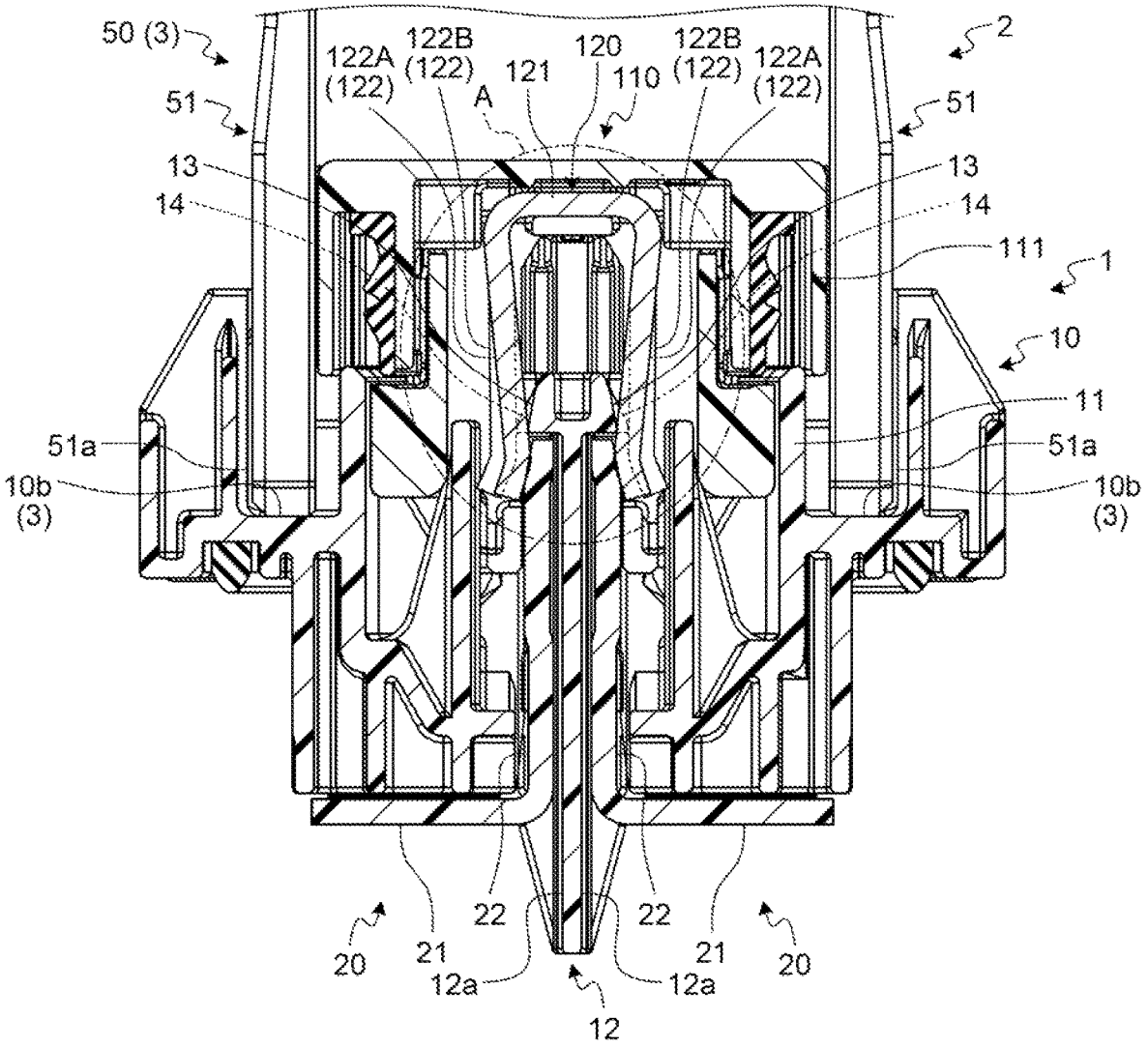
FIG. 5 is a partially enlarged view of a cross-section taken along line X-X of FIG. 4.
Figure 6:
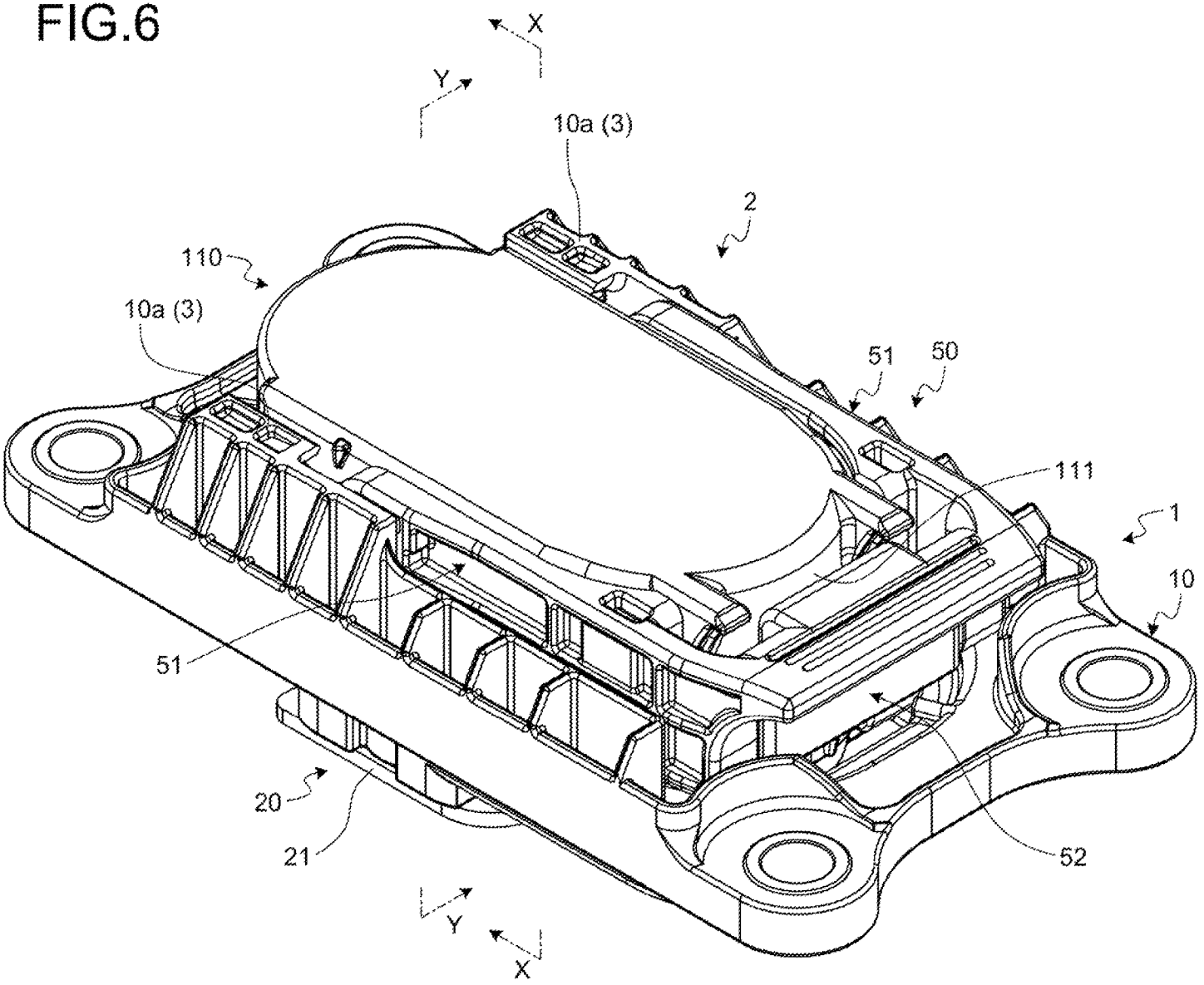
FIG. 6 is a perspective view illustrating the fitting connector according to the embodiment in which the first connector and the second connector are in the completely fitting state.
Figure 7:
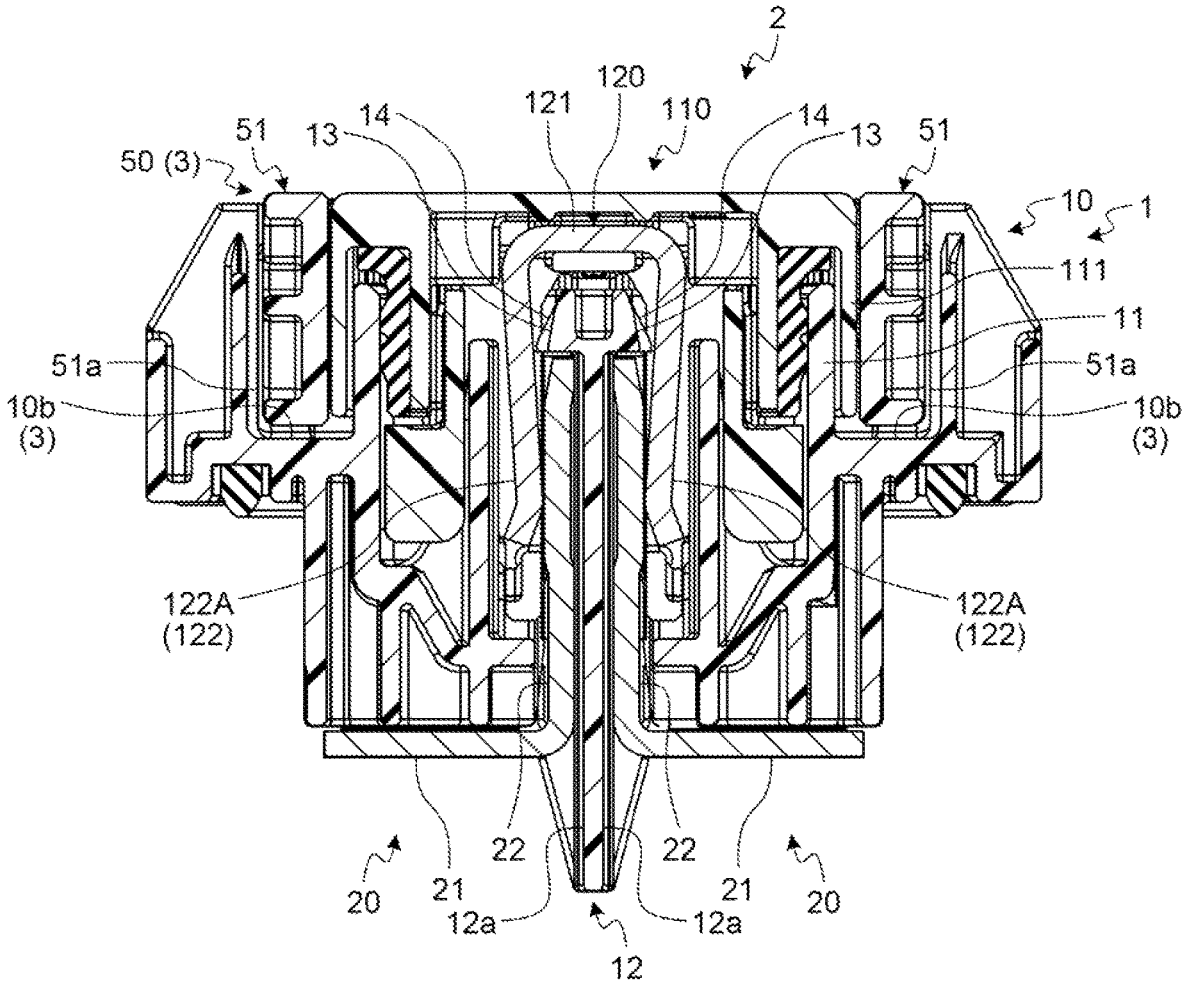
FIG. 7 is a cross-sectional view taken along line X-X of FIG. 6.

In this fitting connector, in a case in which the first connector 1 and the second connector 2 are fitted and connected to each other, the first fitting portion 11 and the second fitting portion 111 are in a temporarily fitting state (a form of the semi-fitted state) in which an end of an opening side of the first connector 1 and an end of an opening side of the second connector 2 are fitted to each other in the cylindrical axial direction (FIG. 4 and FIG. 5), and then the temporarily fitting state of the first fitting portion 11 and the second fitting portion 111 shifts to the completely fitting state (FIG. 6 and FIG. 7). This fitting connector is provided with an operation force auxiliary mechanism 3 that generates a fitting insertion force corresponding to the operation force for an operation auxiliary member 50 between the first fitting portion 11 and the second fitting portion 111 to move the first fitting portion 11 and the second fitting portion 111 relative to each other along the connector insertion direction to be set from the temporarily fitting state to the completely fitting state, in order to reduce a fitting operation force of an operator in a case in which the temporarily fitting state of the first fitting portion 11 and the second fitting portion 111 shifts to the completely fitting state (FIG. 1 to FIG. 7, and FIG. 10).

The operation force auxiliary mechanism 3 may operate, for example, a lever member as the operation auxiliary member 50 to be rotated with respect to the first fitting portion 11 and the second fitting portion 111, so that the fitting insertion force corresponding to a rotary operation force thereof may be generated between the first fitting portion 11 and the second fitting portion 111. The operation force auxiliary mechanism 3 may operate a screw member to rotate around the axis with respect to the first fitting portion 11 and the second fitting portion 111, so that the fitting insertion force corresponding to the rotary operation force thereof may be generated between the first fitting portion 11 and the second fitting portion 111 in order to, for example, make an axial force of the screw member as the operation auxiliary member 50 act between the first fitting portion 11 and the second fitting portion 111.

The operation force auxiliary mechanism 3 illustrated herein uses the lever member as the operation auxiliary member 50. Therefore, in this fitting connector, in a case in which the first connector 1 and the second connector 2 are fitted and connected to each other, the first fitting portion 11 and the second fitting portion 111 are in the temporarily fitting state, and the operation auxiliary member 50 is operated to rotate in the temporarily fitting state, so that the first fitting portion 11 and the second fitting portion 111 are in the completely fitting state in which the first fitting portion 11 and the second fitting portion 111 are deeply fitted and inserted to the specified fitting position. On the other hand, in this fitting connector, in a case in which the first connector 1 and the second connector 2 are separated, the operation auxiliary member 50 is operated to rotate in a direction opposite to the direction in the case in which the first fitting portion 11 and second fitting portion 111 are in the completely fitting state, so that the first fitting portion 11 and the second fitting portion 111 are displaced to be in the temporarily fitting state. In this fitting connector, it is also possible to be in a detachable state in which the first fitting portion 11 and the second fitting portion 111 can be detached in the temporarily fitting state, and the first connector 1 and the second connector 2 are separated by pulling the first fitting portion 11 and the second fitting portion 111 away from each other.

The operation auxiliary member 50 is formed of an insulating material such as a synthetic resin. The operation auxiliary member 50 is provided on the second connector 2. The operation auxiliary member 50 is a member capable of relatively rotating against the second housing 110, and causes a force in the connector insertion direction (fitting insertion force) or a force in the connector pulling out direction (pulling out force) depending on a rotation direction of the relative rotation thereof to act between the first fitting portion 11 and the second fitting portion 111. Therefore, the operation auxiliary member 50 relatively rotates between at least a temporarily fitting position (FIG. 4 and FIG. 5) in a case in which the second housing 110 is in the temporarily fitting state and a completely fitting position in a case in which the second housing 110 is in the completely fitting state (FIG. 6 and FIG. 7) against the second housing 110. The operation auxiliary member 50 causes the second housing 110 to move relative to the first fitting portion 11 to be set from the temporarily fitting state to the completely fitting state by a first rotating operation operated from the temporarily fitting position toward the completely fitting position, thereby the first fitting portion 11 and the second fitting portion 111 being completely fitted. The operation auxiliary member 50 causes the second housing 110 to move relative to the first fitting portion 11 to be set from the completely fitting state to the temporarily fitting state by a second rotating operation operated from the completely fitting position toward the temporarily fitting position, thereby the completely fitting state of the first fitting portion 11 and the second fitting portion 111 being eliminated.

The operation auxiliary member 50 illustrated herein includes a rotation fulcrum for the first rotating operation and the second rotating operation, two arms 51 and 51 disposed to face each other with a gap in an axial direction of a rotation shaft of the first rotating operation and second rotating operation, and an operating portion 52 that connects the two arms 51 and 51 and is a force point of the first rotating operation and the second rotating operation (FIG. 1, FIG. 2, FIG. 4, and FIG. 6).

In the operation auxiliary member 50 illustrated herein, the second fitting portion 111 is disposed between the two arms 51 and 51, and each of the arms 51 and 51 is rotatably attached to the second fitting portion 111. In the operation auxiliary member 50 illustrated herein, in the case of the temporarily fitting position, an extending direction of each of the arms 51 and 51 is toward the connector insertion and pulling out direction, and the operating portion 52 is disposed to face the closing wall of the second fitting portion 111 with a gap (FIG. 4). In addition, in the operation auxiliary member 50 illustrated herein, in the case of the completely fitting position, the extending direction of each of the arms 51 and 51 is orthogonal to the connector insertion and pulling out direction, and the operating portion 52 is disposed to face an outer peripheral surface of the second fitting portion 111 (FIG. 6).

Each arm 51 is formed in a cantilever shape having a fixed end onto the operating portion 52 side, and the rotation fulcrum is provided between the fixed end and a free end 51*a* (FIG. 1, FIG. 2, FIG. 4, and FIG. 10). In each arm 51 illustrated herein, a bearing 51*b* having a circular through-hole is formed as a rotation fulcrum (FIG. 1, FIG. 2, FIG. 4, and FIG. 10). A rotation shaft 112 that is inserted into the through-hole of the bearing 51*b* and is pivotally supported by the bearing 51*b* is provided on the outer peripheral surface of the second fitting portion 111 for each arm 51 in a protruding state (FIG. 1, FIG. 2, FIG. 4, and FIG. 10).

The first housing 10 includes a first receiving portion 10*a* that receives a force from the free end 51*a* of the operation auxiliary member 50 toward the connector pulling out direction during the first rotating operation of this operation auxiliary member 50 (FIG. 1, FIG. 3, FIG. 4, FIG. 6, and FIG. 10). The operation auxiliary member 50 receives a reaction force from this first receiving portion 10*a* by applying the force toward the connector pulling out direction to the first receiving portion 10*a*. The second housing 110 is provided with a second receiving portion 110*a* that receives a force from the rotation fulcrum of the operation auxiliary member 50 receiving the reaction force from the first receiving portion 10*a* during the first rotating operation of the operation auxiliary member 50, and generates a force toward the connector insertion direction to the second fitting portion 111 (FIG. 1, FIG. 2, FIG. 4, and FIG. 10). As a result, in this fitting connector, the first fitting portion 11 and the second fitting portion 111 that are in the temporarily fitting state are fitted and inserted to the specified fitting position to be in the completely fitting state by performing the first rotating operation on the operation auxiliary member 50. That is, this fitting connector can reduce the fitting operation force of the operator in the case in which the temporarily fitting state of the first fitting portion 11 and the second fitting portion 111 shifts to the completely fitting state. The second receiving portion 110*a* illustrated herein is the rotation shaft 112 (FIG. 1, FIG. 2, FIG. 4, and FIG. 10), and a force corresponding to the reaction force from the first receiving portion 10*a* is applied to an inner peripheral wall of the through-hole of the bearing 51*b*.

Figure 10:
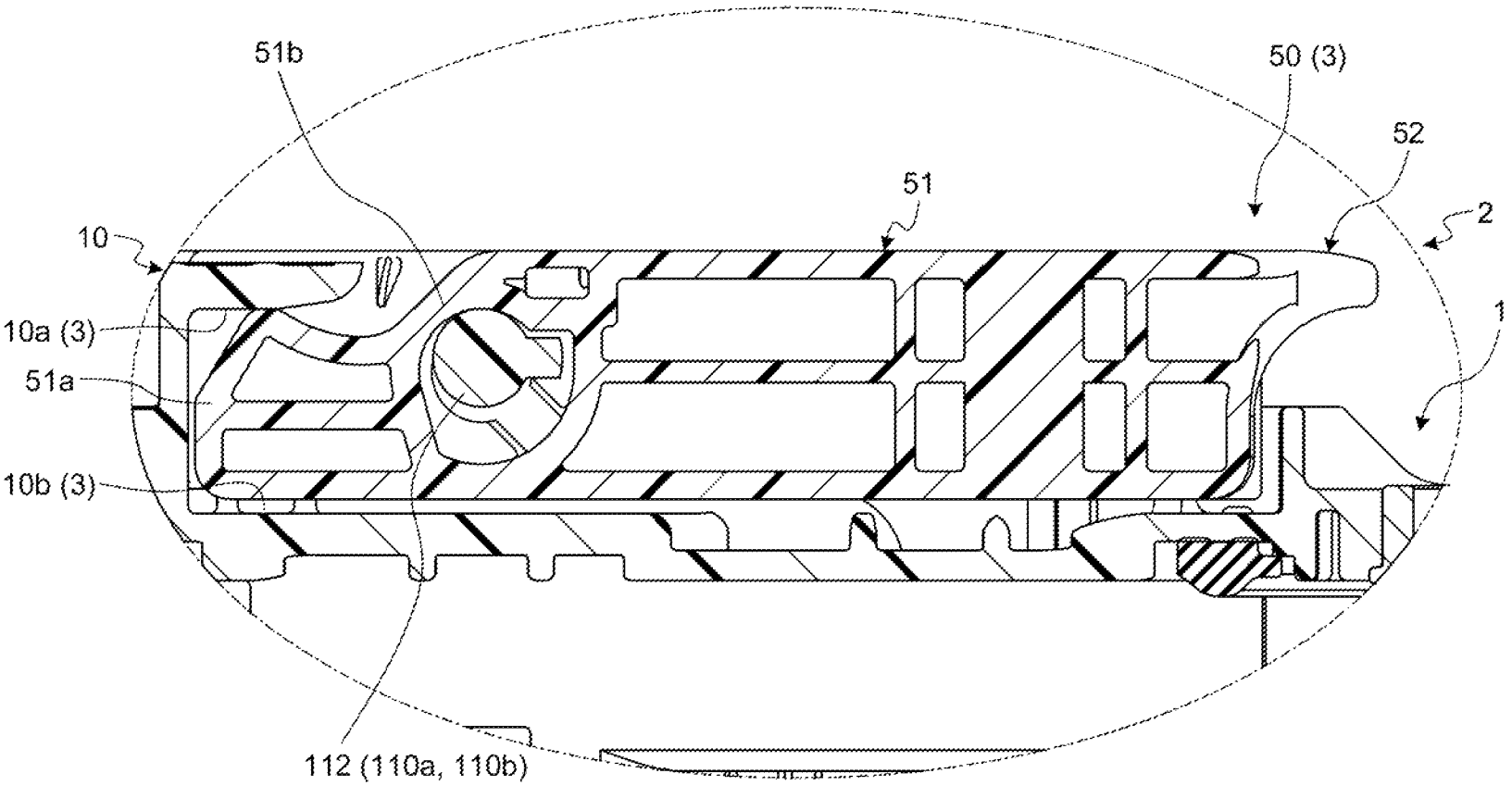
FIG. 10 is a cross-sectional view taken along line Y-Y of FIG. 6.

The first housing 10 includes a third receiving portion 10*b* that receives a force from the free end 51*a* of the operation auxiliary member 50 toward the connector insertion direction during the second rotating operation of the operation auxiliary member 50 (FIG. 3 and FIG. 10). The third receiving portion 10*b* is disposed to face the first receiving portion 10*a* with a gap. The operation auxiliary member 50 receives a reaction force from the third receiving portion 10*b* by applying the force toward the connector insertion direction to the third receiving portion 10*b*. Therefore, the second housing 110 is provided with a fourth receiving portion 110*b* that receives a force from the rotation fulcrum of the operation auxiliary member 50 receiving the reaction force from the third receiving portion 10*b* during the second rotating operation of the operation auxiliary member 50, and generates a force toward the connector pulling out direction to the second fitting portion 111 (FIG. 1, FIG. 2, FIG. 4, and FIG. 10). As a result, in this fitting connector, the fitting allowance of the first fitting portion 11 and the second fitting portion 111 in the completely fitting state is reduced by performing the second rotating operation on the operation auxiliary member 50, so that the completely fitting state shifts to the temporarily fitting state. That is, this fitting connector can reduce the pulling out operation force of the operator in a case in which the completely fitting state of the first fitting portion 11 and the second fitting portion 111 shifts to the temporarily fitting state. The fourth receiving portion 110*b* illustrated herein has the same rotation shaft 112 as the second receiving portion 110*a* (FIG. 1, FIG. 2, FIG. 4, and FIG. 10), and a force corresponding to the reaction force from the third receiving portion 10*b* is applied to the inner peripheral wall of the through-hole of the bearing 51*b*.

As described above, in the fitting connector of the present embodiment, in a case in which the first connector 1 and the second connector 2 are fitted and connected to each other, the ends of the first fitting portion 11 and the second fitting portion 111 are firstly fitted to each other and then the first fitting portion 11 and the second fitting portion 111 are in the temporarily fitting state. Subsequently, in the fitting connector of the present embodiment, the operation auxiliary member 50 is subjected to the first rotating operation, the fitting insertion force is applied to the first fitting portion 11 and the second fitting portion 111 that are in the temporarily fitting state, and the temporarily fitting state of the first fitting portion 11 and the second fitting portion 111 shifts to the completely fitting state. Therefore, in this fitting connector, in a case in which the first fitting portion 11 and the second fitting portion 111 are not correctly disposed in the temporarily fitting state, as described above, the first fitting portion 11 and the second fitting portion 111 may not be fitted and inserted until the first fitting portion 11 and the second fitting portion 111 are in the completely fitting state, or an overload may be generated between the first fitting portion 11 and the second fitting portion 111 or between the first terminal fitting 20 and the second terminal fitting 120.

Therefore, the fitting connector of the present embodiment is configured so that the operator can easily identify whether the first fitting portion 11 and the second fitting portion 111 are in the temporarily fitting state. In the fitting connector of the present embodiment, in a case in which the ends of the first fitting portion 11 and the second fitting portion 111 are fitted to each other until the first fitting portion 11 and the second fitting portion 111 are in the temporarily fitting state, the fitting insertion force between the first connector 1 and the second connector 2 changes, so that the operator identifies whether the first fitting portion 11 and the second fitting portion 111 are in the temporarily fitting state.

Specifically, in the fitting connector of the present embodiment, the elastic connection bodies 122 of the second terminal fitting 120 is roughly distinguished into an elastic connection body 122A that generates a reference spring force by the elastic deformation in the opening direction (hereinafter, referred to as a "reference elastic connection body") and an elastic connection body 122B that generates a higher-pressure spring force than that of the reference spring force by the elastic deformation in the opening direction (hereinafter, referred to as a "high-pressure elastic connection body") until the first fitting portion 11 and the second fitting portion 111 are in the temporarily fitting state (FIG. 5, FIG. 8, FIG. 9, and FIG. 11). In the case in which the first fitting portion 11 and the second fitting portion 111 are in the temporarily fitting state, the first housing 10 is provided with a protrusion body (hereinafter, referred to as a "reference protrusion body") 13 that allows the reference elastic connection body 122A to ride over while elastically deforming the reference elastic connection body 122A in the opening direction, and a protrusion body (hereinafter, referred to as a "high-pressure protrusion body") 14 that allows the high-pressure elastic connection body 122B to ride over while elastically deforming the high-pressure elastic connection body 122B in the opening direction (FIG. 1, FIG. 3, FIG. 5, FIG. 7, FIG. 9, and FIG. 11).

The reference protrusion body 13 and the high-pressure protrusion body 14 are provided closer to the connector pulling out direction side than to an end surface on the connector pulling out direction side in the electric connection body 22 of the first terminal fitting 20 (FIG. 3, FIG. 5, and FIG. 7). The reference protrusion body 13 and the high-pressure protrusion body 14 illustrated herein are provided such that the end surface of the partition wall 12 on the connector pulling out direction side is in a protruding state. The reference protrusion body 13 and the high-pressure protrusion body 14 protrude from a protrusion reference surface 12*a* of the first housing 10 (FIG. 3, FIG. 5, FIG. 7, and FIG. 11). Here, each planar surface in the partition wall 12 (a part disposed to face the planar surface on one side of the electric connection body 22) is referred to as a protrusion reference surface 12*a*.

The reference protrusion body 13 may be provided one by one for each reference elastic connection body 122A, and in a case in which a plurality of the reference elastic connection bodies 122A are connected by the combination of the elastic connection bodies 122, one reference protrusion body 13 may be provided so as to correspond to the reference elastic connecting bodies 122A. Similarly, the high-pressure protrusion body 14 may be provided one by one for each high-pressure elastic connection body 122B, and in a case in which a plurality of the high-pressure elastic connection bodies 122B are connected by the combination of the elastic connection bodies 122, one high-pressure protrusion body 14 may be provided so as to correspond to the reference elastic connecting bodies 122B. In the second terminal fitting 120 of this example, two adjacent reference elastic connection bodies 122A are set and one high-pressure elastic connection body 122B is set by the combination of the elastic connection bodies 122. In the first housing 10 of this example, one reference protrusion body 13 corresponding to the two adjacent reference elastic connection bodies 122A and one high-pressure protrusion body 14 corresponding to one high-pressure elastic connection body 122B are formed for each combination of the elastic connection bodies 122 and for each second terminal fitting 120.

Figure 11:
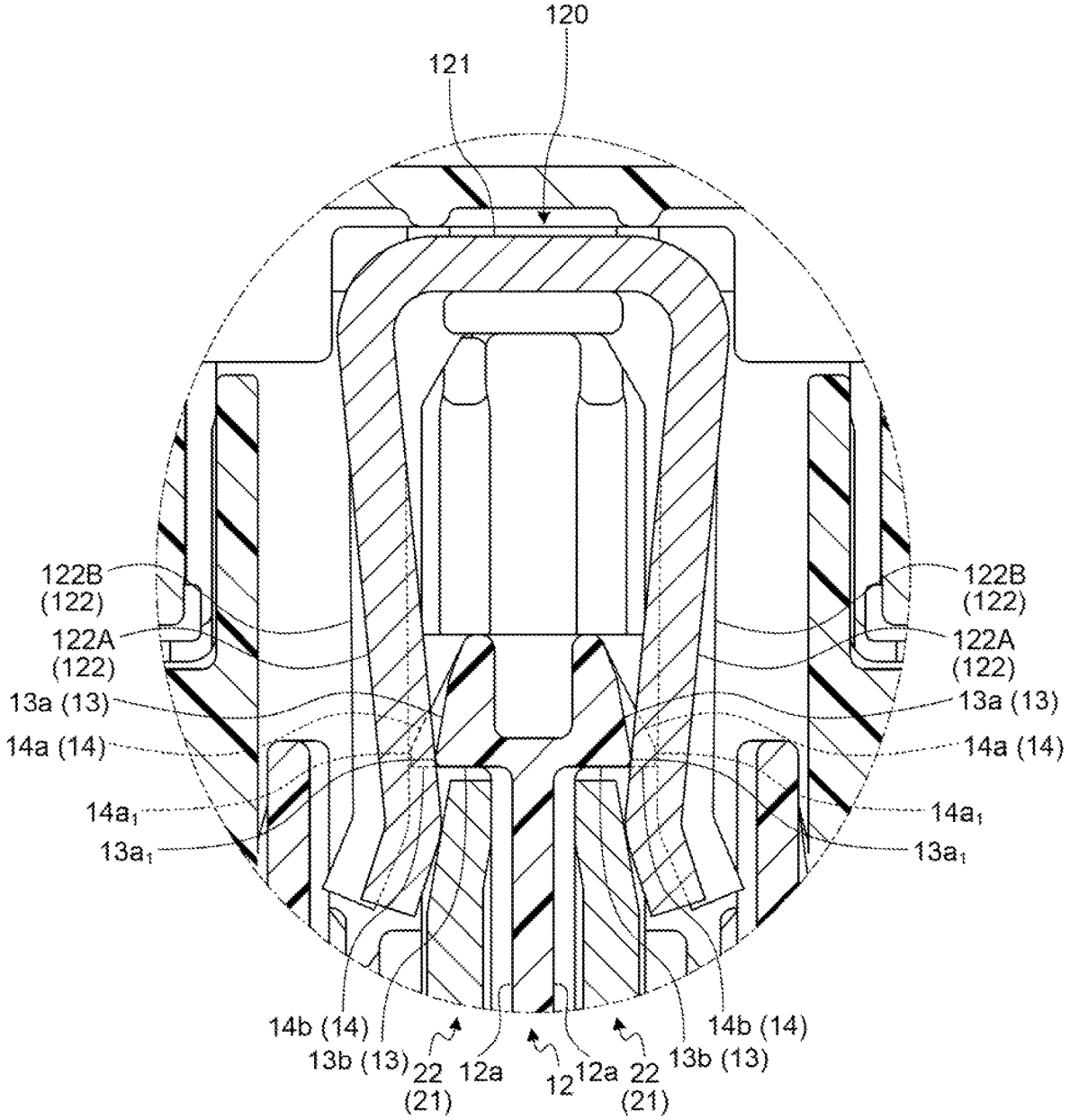
FIG. 11 is an enlarged view of part A in FIG. 5.

The reference protrusion body 13 elastically deforms the reference elastic connection bodies 122A in the opening direction while sliding the free end sides of the reference elastic connection bodies 122A as the first fitting portion 11 and the second fitting portion 111 oriented in the temporarily fitting state are fitted and inserted, and allows the electric contact portions 122*a* of the reference elastic connection bodies 122A to ride over in the case in which the first fitting portion 11 and the second fitting portion 111 are in the temporarily fitting state (FIG. 3 to FIG. 5). The reference protrusion body 13 includes a sliding surface (hereinafter, referred to as a "reference sliding surface") 13*a* over which the free end sides of the reference elastic connection bodies 122A slide and an end surface (hereinafter, referred to as a "connection end surface") 13*b* through which the reference sliding surface 13*a* is connected to the protrusion reference surface 12*a* at the connector insertion direction side (FIG. 11). The connection end surface 13*b* illustrated herein is vertically hung from the protrusion reference surface 12*a*.

The high-pressure protrusion body 14 more greatly elastically deforms the high-pressure elastic connection body 122B than the reference elastic connection bodies 122A in the opening direction while sliding the free end side of the high-pressure elastic connection body 122B as the first fitting portion 11 and the second fitting portion 111 oriented in the temporarily fitting state are fitted and inserted, allows the electric contact portion 122*a* of the high-pressure elastic connection body 122B to ride over in a case in which the first fitting portion 11 and the second fitting portion 111 are in the temporarily fitting state, and returns the high-pressure elastic connection body 122B toward a direction opposite to the opening direction to the same position as the reference elastic connection body 122A (FIG. 3 to FIG. 5). The high-pressure protrusion body 14 includes a sliding surface (hereinafter, referred to as a "high-pressure sliding surface") 14*a* over which the free end side of the high-pressure elastic connection body 122B slides and an end surface (hereinafter, referred to as a "connection end surface") 14*b* through which the high-pressure sliding surface 14*a* is connected to the protrusion reference surface 12*a* at the connector insertion direction side (FIG. 11). The connection end surface 14*b* illustrated herein is vertically hung from the protrusion reference surface 12*a*.

Figure 12:
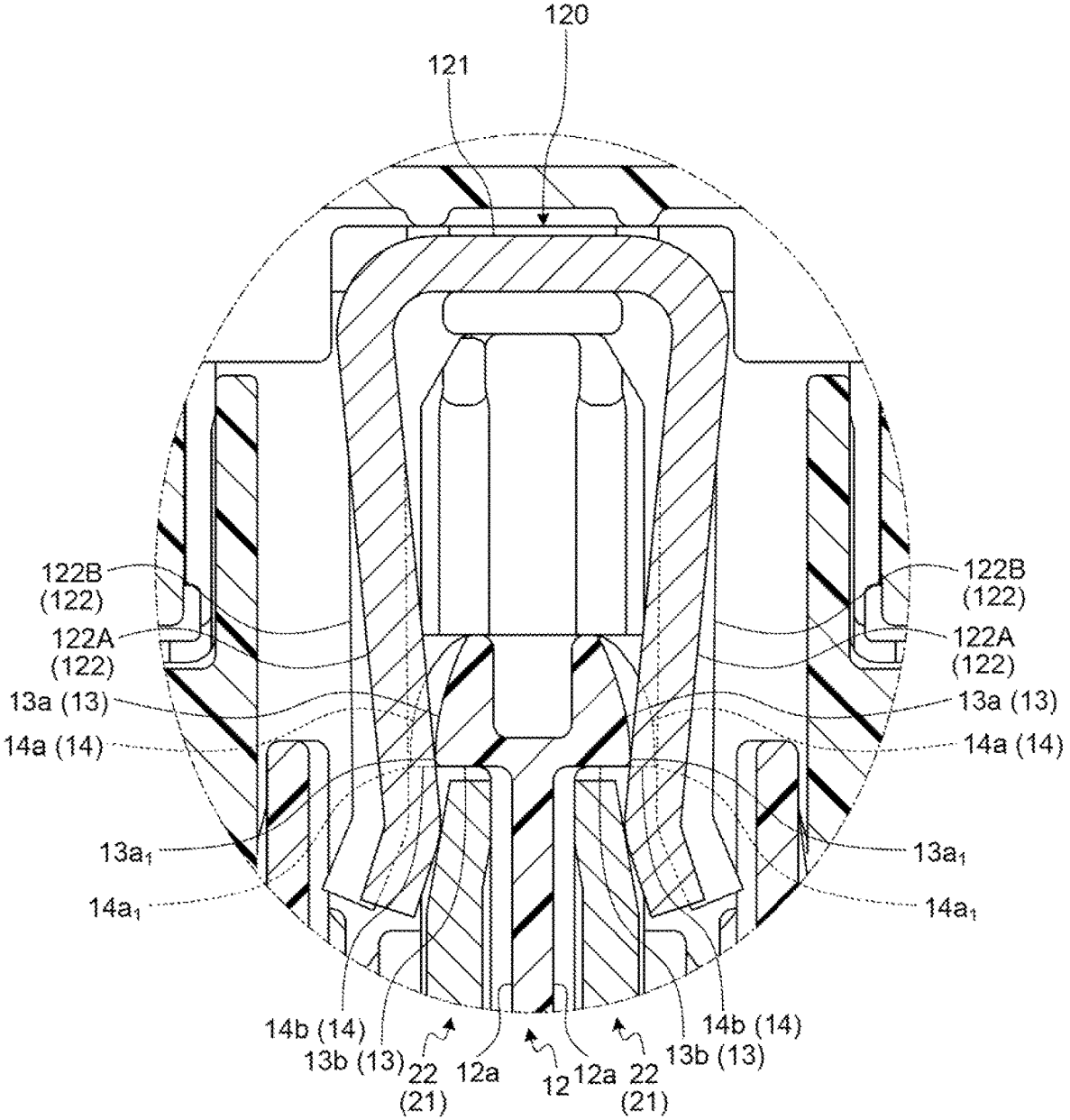
FIG. 12 is a view illustrating modified forms of a reference protrusion body and a high-pressure protrusion body.

The reference protrusion body 13 and the high-pressure protrusion body 14 are formed so that the amount of elastic deformation in the opening direction increases as the first fitting portion 11 and the second fitting portion 111 are further fitted and inserted. Therefore, the reference sliding surface 13*a* has a reference high-pressure portion 13$a_l$ that most elastically deforms the reference elastic connection bodies 122A in the opening direction at its boundary with the connection end surface 13*b* (FIG. 11). Similarly, the high-pressure sliding surface 14*a* has a high-pressure portion 14$a_l$ that most elastically deforms the high-pressure elastic connection body 122B in the opening direction at its boundary with the connection end surface 14*b* (FIG. 11). For example, the reference sliding surface 13*a* and the high-pressure sliding surface 14*a* are formed as one or more inclined surfaces (FIG. 11) each of which greatly protrudes from the protrusion reference surface 12*a* as closer to the connector insertion direction side, or an arcuate surface that gradually greatly protrudes from the protrusion reference surface 12*a* toward the connector insertion direction (FIG. 12).

In this fitting connector, in the case in which the ends of the first fitting portion 11 and the second fitting portion 111 are fitted to each other to be in the temporarily fitting state, the reference elastic connection bodies 122A slide along the reference protrusion body 13 while being elastically deformed in the opening direction, and the high-pressure elastic connection body 122B slides along the high-pressure protrusion body 14 while being elastically deformed in the opening direction. In this fitting connector, in the case in which the first fitting portion 11 and the second fitting portion 111 are in the temporarily fitting state, the electric contact portions 122*a* of the reference elastic connection bodies 122A ride over the reference protrusion body 13, and the electric contact portion 122*a* of the high-pressure elastic connection body 122B rides over the high-pressure protrusion body 14. In the case in which the reference elastic connection bodies 122A ride over the reference protrusion body 13, the amount of elastic deformation decreases due to the reaction force accompanying the elastic deformation in the opening direction, and the reference elastic connection bodies 122A are displaced to a state of being elastically deformed in the opening direction or a state of the original shape before the elastic deformation by the amount of elastic deformation that is smaller than that of the case in which the reference elastic connection bodies 122A ride over the reference protrusion body 13. In the case in which the high-pressure elastic connection body 122B rides over the high-pressure protrusion body 14, the amount of elastic deformation decreases due to the reaction force accompanying the elastic deformation in the opening direction, and the high-pressure elastic connection body 122B is displaced to the same position as the reference elastic connection body 122A.

As described above, in this fitting connector, in the case in which the ends of the first fitting portion 11 and the second fitting portion 111 are fitted to each other to be in the temporarily fitting state, insertion resistance generated due to the presence of the combination of the high-pressure elastic connection body 122B and the high-pressure protrusion body 14 can be increased as compared with a case in which only the combination of the reference elastic connection bodies 122A and the reference protrusion body 13 is present. Therefore, this fitting connector allows the operator to feel the insertion resistance. In addition, in this fitting connector, in the case in which the first fitting portion 11 and the second fitting portion 111 are in the temporarily fitting state, the reduction amount of the insertion resistance generated due to the presence of the combination of the high-pressure elastic connection body 122B and the high-pressure protrusion body 14 is increased as compared with the case in which only the combination of the reference elastic connection bodies 122A and the reference protrusion body 13 is present. Thus, this fitting connector allows the operator to feel a sense of disconnection in the case in which the insertion resistance is decreased. Therefore, with the fitting connector of the present embodiment, the operator can easily identify whether the first fitting portion 11 and the second fitting portion 111 are in the temporarily fitting state.

In this fitting connector, in the case in which the electric contact portion 122*a* of the high-pressure elastic connection body 122B rides over the high-pressure protrusion body 14, the free end side of the high-pressure elastic connection body 122B may be brought into contact with, for example, the electric connection body 22. In this case, the free end side of the high-pressure elastic connection body 122B generates a tapping sound when the free end side of the high-pressure elastic connection body 122B is brought into contact with the electric connection body 22. Therefore, in this case of the fitting connector, the operator can easily identify whether the first fitting portion 11 and the second fitting portion 111 are in the temporarily fitting state due to the tapping sound generated in the case in which the electric contact portion 122*a* of the high-pressure elastic connection body 122B rides over the high-pressure protrusion body 14.

Here, this fitting connector may be formed of only the combination of the high-pressure elastic connection body 122B and the high-pressure protrusion body 14 without the combination of the reference elastic connection bodies 122A and the reference protrusion body 13. Thereby, in this fitting connector, the insertion resistance until the electric contact portion 122*a* of the high-pressure elastic connection body 122B rides over the high-pressure protrusion body 14 is increased as compared with the above example, so that the reduction amount of the insertion resistance generated in the case in which the electric contact portion 122*a* rides over the high-pressure protrusion body 14 is increased, allowing the operator to feel the sense of disconnection at that time. Therefore, in this fitting connector, identifiability of whether the first fitting portion 11 and the second fitting portion 111 are in the temporarily fitting state is improved. However, in a case in which the insertion resistance of this fitting connector is excessively increased, the workability in the case in which the first fitting portion 11 and the second fitting portion 111 are in the temporarily fitting state may be lowered. Therefore, in the fitting connector of the present embodiment, as in the above example, both the combination of the reference elastic connection bodies 122A and the reference protrusion body 13 and the combination of the high-pressure elastic connection body 122B and the high-pressure protrusion body 14 can be employed to optimize the insertion resistance so as not to be excessive.

In addition, in this fitting connector, the insertion resistance in the case in which the first fitting portion 11 and the second fitting portion 111 are in the temporarily fitting state can be adjusted by only adjusting the shape of the high-pressure sliding surface 14*a* such that the protruding amount of the high-pressure sliding surface 14*a* with respect to the protrusion reference surface 12*a* is changed. Therefore, with this fitting connector, the operator can easily identify whether the first fitting portion 11 and the second fitting portion 111 are in the temporarily fitting state with the simple structure.

In the related art, in this type of fitting connector, in order to prevent the terminals from colliding to each other in a case in which the two connectors are fitted and connected to each other, a collision preventing portion that protrudes beyond the end of one terminal fitting may be installed in one housing. Therefore, in the fitting connector, the reference protrusion body 13 and the high-pressure protrusion body 14 may be provided with the collision preventing portion, and the reference protrusion body 13 and the high-pressure protrusion body 14 may also be used as the collision preventing portions.

In the fitting connector according to the present embodiment, in the case in which the first fitting portion and the second fitting portion are in the temporarily fitting state, the insertion resistance generated due to the presence of the combination of the high-pressure elastic connection body and the high-pressure protrusion body can be increased as compared with the case in which only the combination of the reference elastic connection bodies and the reference protrusion body is present. Therefore, this fitting connector allows the operator to feel the insertion resistance. In addition, in this fitting connector, in the case in which the first fitting portion and the second fitting portion are in the temporarily fitting state, the reduction amount of the insertion resistance generated due to the presence of the combination of the high-pressure elastic connection body and the high-pressure protrusion body is increased as compared with the case in which only the combination of the reference elastic connection bodies and the reference protrusion body is present. Thus, this fitting connector allows the operator to feel the sense of disconnection in the case in which the insertion resistance is decreased. Therefore, with the fitting connector of the present embodiment, the operator can easily identify whether the first fitting portion and the second fitting portion are in the temporarily fitting state.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A fitting connector comprising:

a first connector including a first housing that has a first fitting portion, and a first terminal fitting that is housed in the first housing;

a second connector including a second housing that has a second fitting portion capable of being fitted and inserted to the first fitting portion along a connector insertion direction, and a second terminal fitting that is housed in the second housing and electrically connected to the first terminal fitting in a case where the first fitting portion and the second fitting portion are in a completely fitting state; and an operation force auxiliary mechanism that generates a fitting insertion force corresponding to an operation force for an operation auxiliary member between the first fitting portion and the second fitting portion, and moves the first fitting portion and the second fitting portion relative to each other along the connector insertion direction to be set from a temporarily fitting state to the completely fitting state, wherein the second terminal fitting includes a base body and a plurality of elastic connection bodies, the elastic connection bodies being disposed in an intersecting state to the base body, arranged in an orthogonal direction to the connector insertion direction with electric contact portions on a free end side, which are oriented in the same direction, cantilever shaped, and capable of elastically deforming the electric contact portions toward an opening direction in which the electric contact portions are pulled away from the first terminal fitting, and the first housing includes a reference protrusion body and a high-pressure protrusion body, the reference protrusion body elastically deforming a reference elastic connection body in the opening direction while sliding the free end side of the reference elastic connection body of the elastic connection bodies as the first fitting portion and the second fitting portion oriented in the temporarily fitting state are fitted and inserted, and allowing each electric contact portion of the reference elastic connection body to ride over in a case in which the first fitting portion and the second fitting portion are temporarily fitted, and the high-pressure protrusion body more greatly elastically deforming a high-pressure elastic connection body in the opening direction than the reference elastic connection body while sliding the free end side of the high-pressure elastic connection body of the elastic connection bodies as the first fitting portion and the second fitting portion oriented in the temporarily fitting state are fitted and inserted, allowing each electric contact portion of the high-pressure elastic connection body to ride over in the case in which the first fitting portion and the second fitting portion are in the temporarily fitting state, and returning the high-pressure elastic connection body toward a direction opposite to the opening direction to the same position as the reference elastic connection body.

2. The fitting connector according to claim 1, wherein the reference protrusion body and the high-pressure protrusion body protrude from a protrusion reference surface of the first housing, the high-pressure protrusion body includes a high-pressure sliding surface over which the free end side of the high-pressure elastic connection body slides, and a connection end surface through which the high-pressure sliding surface is connected to the protrusion reference surface at the connector insertion direction side, and the high-pressure sliding surface includes a high-pressure portion most elastically deforming the high-pressure elastic connection body in the opening direction at a boundary with the connection end surface.

3. The fitting connector according to claim 2, wherein the high-pressure sliding surface is one or more inclined surfaces each greatly protruding from the protrusion reference surface as closer to the connector insertion direction side, or an arcuate surface gradually greatly protruding from the protrusion reference surface toward the connector insertion direction.

4. The fitting connector according to claim 1, wherein the second terminal fitting includes two combinations of the elastic connection bodies, and the electric contact portions of the elastic connection bodies in each of the two combinations are disposed to face each other with a gap.

5. The fitting connector according to claim 2, wherein the second terminal fitting includes two combinations of the elastic connection bodies, and the electric contact portions of the elastic connection bodies in each of the two combinations are disposed to face each other with a gap.

6. The fitting connector according to claim 3, wherein the second terminal fitting includes two combinations of the elastic connection bodies, and the electric contact portions of the elastic connection bodies in each of the two combinations are disposed to face each other with a gap.

* * * * *